United States Patent [19]

Eriksson

[11] 4,385,796

[45] May 31, 1983

[54] BATTERY TERMINAL POST CLAMP

[76] Inventor: Lars Eriksson, Djurgardsvägen 15, S-633 40 Eskilstuna, Sweden

[21] Appl. No.: 195,218

[22] Filed: Oct. 7, 1980

[30] Foreign Application Priority Data

Oct. 12, 1979 [SE] Sweden ..... 7908486

[51] Int. Cl.[3] ..... H01R 11/02

[52] U.S. Cl. ..... 339/238

[58] Field of Search ..... 339/238, 239, 266, 274

[56] References Cited

U.S. PATENT DOCUMENTS

| | | | |
|---|---|---|---|
| 1,491,056 | 4/1924 | Morrison et al. . | |
| 1,596,891 | 8/1926 | Rensch . | |
| 1,930,772 | 10/1933 | Richter et al. . | |
| 1,943,190 | 1/1934 | Sands . | |
| 2,185,419 | 1/1940 | Packard | 339/239 |
| 2,235,935 | 3/1941 | Lee | 339/238 |
| 2,470,104 | 5/1949 | Martin | 339/238 |
| 3,568,139 | 3/1971 | Delzer | 339/239 |

FOREIGN PATENT DOCUMENTS 129178 8/1950 Sweden .

*Primary Examiner*—Joseph H. McGlynn
*Attorney, Agent, or Firm*—James Creighton Wray.

[57] ABSTRACT

A battery terminal post clamp with a quick-coupling device for its connection to a battery terminal post is disclosed. The clamp consists of two U-shaped parts (1,2). The legs (21,22) of one of the parts (2) extend through openings (8,9) in the legs (6,7) of the other part (1), which latter legs also have guide recesses (14,15) for the legs (21,22) of the first mentioned part (2). The two parts are movable relative each other under the influence of an excenter or toggle joint mechanism (23,24,25), which has a dead-point position where the post contacting portions (5,18) of the U-shaped parts (1,2) are located closest to each other.

11 Claims, 8 Drawing Figures

BATTERY TERMINAL POST CLAMP

The present invention relates to a battery terminal post clamp with a quick-coupling device for its connection to a storage battery terminal post.

The clamp according to the invention is primarily intended to be connected to a cylindrical or truncated conical post commonly existing on storage batteries and includes, to this purpose, two parts movable in relation to each other, said parts having co-operating portions, preferably in the shape of substantially axially halved cylinders or truncated cones which together in the active position of the clamp clasp the post under the influence of a force contracting the parts and being achieved by a toggle joint or over-the-center mechanism connected to both parts.

What is especially characterizing for the invention appears from the appended claims.

Figure 1:
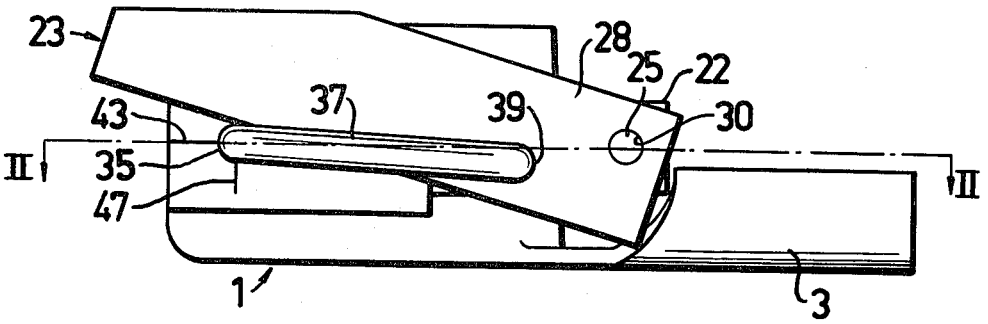
Figure 2:
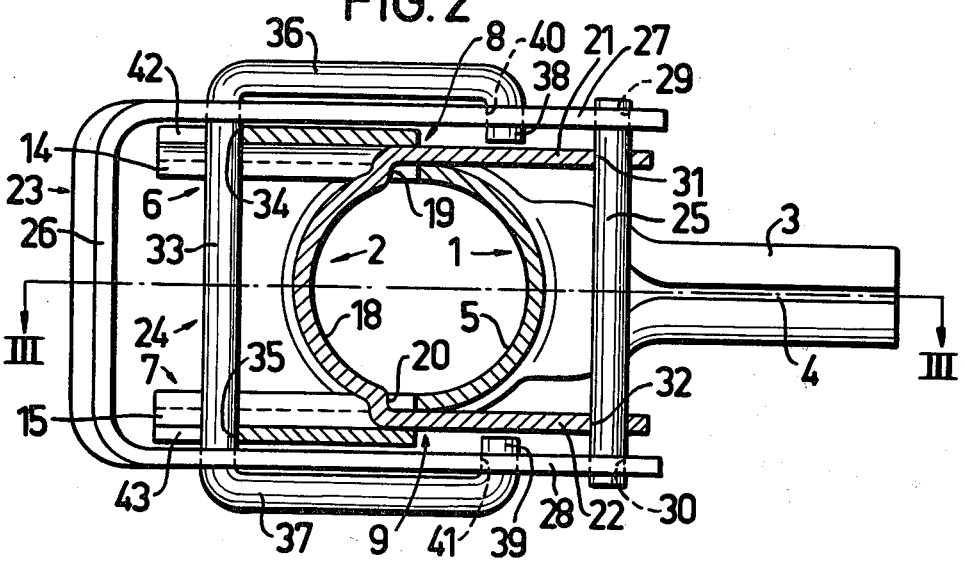
Figure 3:
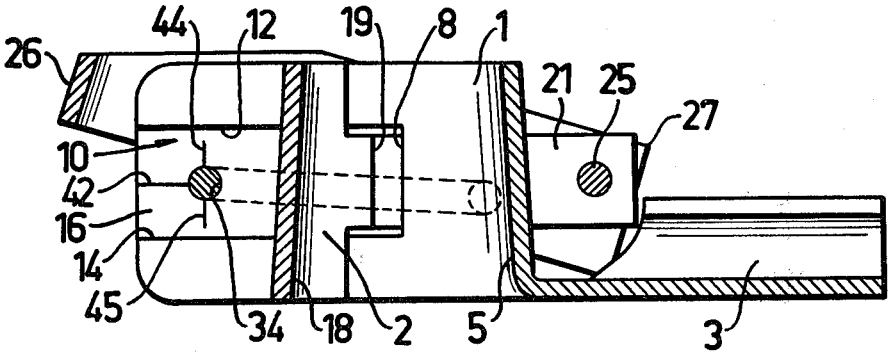
Figure 4:
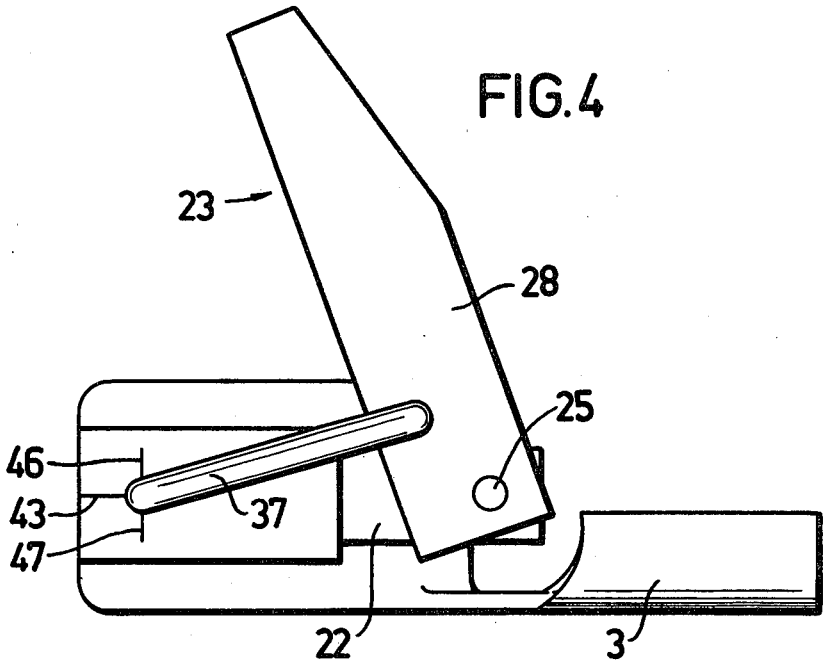
Figure 5:
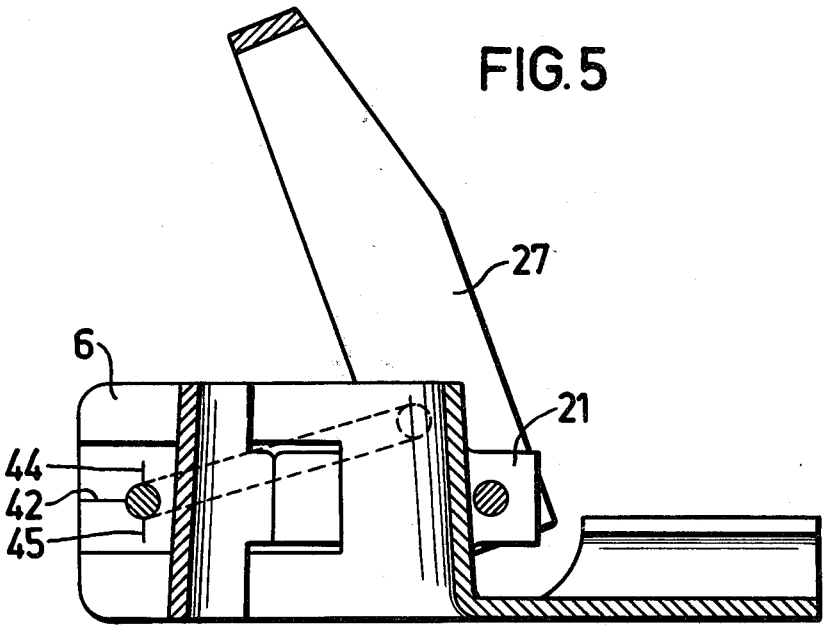
Figure 6:
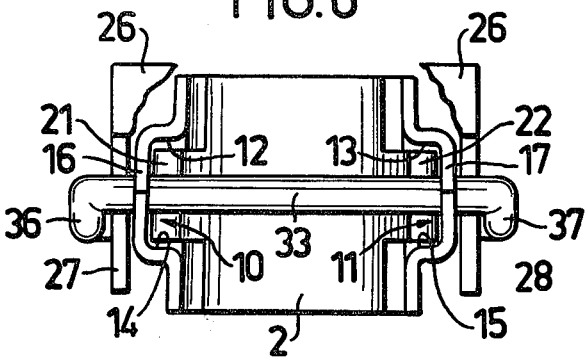
Figure 7:
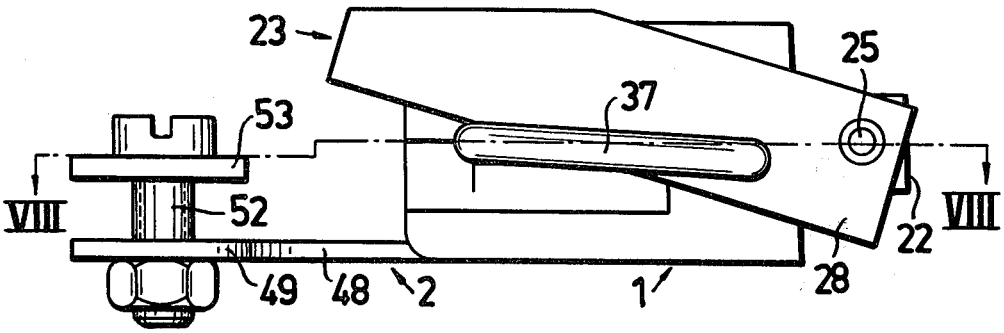
Figure 8:
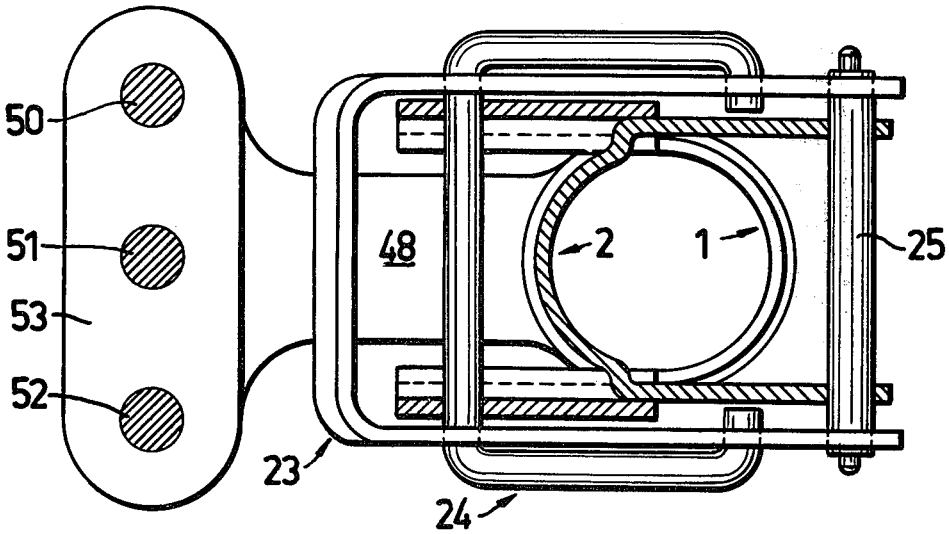

The invention will be described more in detail below with reference to the attached drawings, wherein FIG. 1 is a side-view showing a post clamp according to the invention in a closed position, FIG. 2 is a section taken along the line II—II of FIG. 1 but excluding the operating lever of the excenter mechanism, FIG. 3 is a longitudinal section through the post clamp taken along the line III—III of FIG. 2, FIG. 4 is a side-view of the post clamp in an open position, FIG. 5 is a longitudinal section similar to that according to FIG. 3 but showing the clamp in an open position, FIG. 6 is a view seen from the left in FIG. 1 showing the post clamp in a closed position, the operating lever for the sake of clarity being shown partly broken away, FIG. 7 is a view similar to that according to FIG. 1 showing another embodiment of the battery post clamp according to the invention and FIG. 8 is a section taken along the line VIII—VIII of FIG. 7 corresponding to the one according to FIG. 2 through the post according to FIG. 1.

The battery post clamp according to the invention includes a first part 1 and a relative thereto movable second part 2, which two parts preferably are punched and bent sheet metal details. Part 1 comprises a cylindrical connection portion 3 for a non-shown battery cable. The connection portion 3 has a longitudinal slit 4 and is adapted to be clamped around a cable for electric connection thereto through plastic deformation or contraction by for example a hose-clamp. In its end opposite the connection portion 3 part 1, seen from above (FIG. 2), is substantially U-shaped with an arcuately curved bottom portion 5 and two mutually parallel straight legs 6 and 7 extending from the bottom portion 5. In the embodiment shown the bottom portion 5 consists essentially of a semi-circle arch, from which the legs 6 and 7 tangentially extend.

In the transition from the bottom portion 5 the legs 6 and 7 are provided with vertical slots 8 and 9, respectively, from which the center portions of the legs—vertically counted—are pressed out so that longitudinal guide recesses 10 and 11, respectively, have been formed, which recesses are open backwardly through the slots 8 and 9, respectively, in the direction towards the connection portion 3. The guide recesses 10, 11 and the slots 8, 9 have a substantially rectangular shape and a somewhat greater height (FIGS. 3, 5 and 6) and width (FIGS. 2 and 6) than the co-operative parts of part 2, as will be described below. The guide recesses 10 and 11 are defined upwards by substantially plane guide surfaces 12 and 13, respectively, and downwards by likewise substantially plane guide surfaces 14 and 15, respectively. Outwardly the guide recesses are defined by the pressed out portions 16 and 17, respectively, of the legs 6 and 7.

Seen from above also part 2 is substantially U-shaped with an arcuately curved bottom portion 18, which in the shown embodiment is somewhat smaller than a semi-circle arch, but has the same curve radius as the bottom portion 5 of part 1. The bottom portion 18 has a height corresponding to the height of bottom portion 5 of part 1 and its legs 6 and 7. From the center area of the bottom portion 18—vertically counted—two mutually parallel legs 21 and 22 extend via an outwardly angled transition portion 19 and 20, respectively, which legs extend within the guide recesses 10 and 11, respectively, and through the slots 8 and 9, respectively.

The parts 1 and 2, thus, are movable relative to each other under mutual guidance by, on one hand, the guide recesses 10, 11 and the slots 8, 9, and, on the other hand, the legs 21, 22.

In order to control this movement the battery post clamp according to the invention is provided with a mechanism coupled between the parts 1 and 2, which mechanism consists of a U-shaped operating lever 23 (FIG. 2), a substantially U-shaped link 24 connected to the operating lever 23 and to part 1, as well as a shaft 25 connecting the operating lever 23 and part 2.

The operating lever 23, which for example is a detail manufactured from bent sheet, is provided with a web portion 26 and two parallel legs 27 and 28 which extend outside the legs 6 and 7 of part 1. Adjacent their free end portions the legs 27 and 28 have holes 29 and 30, respectively, in which engage the end portions of the shaft 26 which is furthermore introduced through holes 31 and 32 adjacent to the free end portions of the legs 21 and 22, respectively, of part 2. The operating lever 23, thus, is pivotable around the shaft 25.

The link 24, which has circular cross section, is provided with a portion 33 which is parallel to the shaft 25 and is mounted in holes 34 and 35 adjacent to the free end portions of the legs 6 and 7, respectively, of part 1. From the portion 33 two parallel legs 36 and 37 extend outside the legs 27 and 28, respectively, of the lever 23 and engage from the outside by means of inwardly turned end portions 38 and 39, respectively, in holes 40 and 41, respectively, in the legs 27 and 28, respectively, of the lever 23.

The holes 31 and 32 of part 2 are arranged at the same height as the holes 34 and 35 in part 1 which means that the shaft 25 and the portion 33 of the link 24 are located in the very same horizontal plane. The holes 40 and 41 in the legs 27 and 28, respectively, of the lever 23 are so located, however, that the inwardly turned end portions 38 and 39 of the link 24 are located somewhat below this plane in the closed position of the clamp according to FIG. 1 and pass through the same plane when closing the terminal, i.e. when the operating lever 23 is brought from the position shown in FIG. 4, where the clamp is open, to the position shown in FIG. 1. As is apparent, the distance between the shaft 25 and the link portion 33 is increased during this closing movement, which means that the free end portions of the legs 21, 22 of part 2 are brought away from the free end portions of the legs 6, 7 of part 1, while simultaneously the curved portion 18 of part 2 is brought towards the curved portion 5 of part 1. The smallest distance between the curved portions 18 and 5—and thereby the greatest clamping force—is of course achieved when the inwardly turned end portions 38 and 39 of the legs 27 and 28, respectively, of the link 24 pass through the common plane of the shaft 25 and the like portion 33, i.e. the dead-point position of the operating mechanism.

In the closed position according to FIG. 1, in which the legs 27 and 28 of the operating lever 23 rest against the outer portions of the link portion 33, the operating lever is kept in the closed position, i.e. with the inwardly turned end portions 38 and 39 of the link 24 below the dead-point position, by the tension in the various parts of the clamp.

To enable the mounting of the link 24 the blank of part 1 is provided with slots 42 and 43 extending from the free end portions of the legs 6 and 7, respectively, to the holes 34 and 35, respectively, as well as slots 44, 45 and 46, 47, respectively, extending a bit upwards and downwards, respectively, from the holes 34 and 35. By the presence of these slots the material can be bent out so that a sufficient passage is formed for the introduction of the link portion 33 into the holes 34 and 35, whereafter the bent out flaps again are bent inwards to the position shown in the drawings.

Another embodiment of the invention is shown in FIGS. 7 and 8, wherein corresponding details have been given the same reference numerals as in FIGS. 1–6. The embodiment according to FIGS. 7 and 8 corresponds mechanically to the one earlier described. The difference consists in that cable connection is made to a substantially T-shaped connecting tongue 48 integral with part 2, said tongue 48 in its free end having a transverse portion 49. This portion is provided with three holes through which extend three screws 50, 51 and 52 having respective nuts, said screws also extending through a loose plate 53. With this arrangement one, two or more cables can be connected to the clamp by being introduced between the plate 53 and the portion 49 and between the screws 50 and 51 and/or the screws 51 and 52, whereafter the screws are tightened so that the cable/cables are clamped between the portion 49 and the plate 53.

The embodiment according to FIGS. 7 and 8 also brings about the advantage that the tongue 48 is easily bent (e.g. upwardly according to FIG. 7), which facilitates the mounting of the clamp on terminal posts of certain battery types as well as cable connection in confined spaces.

A handle means of suitable shape and suitable material, e.g. plastic, is preferably arranged on the operating lever 23.

I claim:

1. Battery terminal post clamp with a quick-coupling device for connection to a battery post comprising a first part and a second part which are moveable in relation to each other and have portions facing each other, said portions being formed substantially in correspondence with the shape of the battery terminal post and arranged to together substantially clasp the battery terminal post in an operating position, control means which upon actuation brings the parts towards or away from each other comprising a toggle joint mechanism connected to the parts having a dead-point position in the position where said portions of the parts are located closest to each other, wherein the parts are substantially U-shaped with a bottom portion and parallel legs extending from said bottom portion, the legs of said first part in the transition areas from its bottom portion having openings through which the legs of the second part extend.

2. Battery terminal post clamp according to claim 1 comprising guide means independent of the control means for guiding the parts relative to each other.

3. Battery terminal post clamp according to claims 1 or 2 wherein the legs of the first part are formed with guide recesses running in the longitudinal direction of the legs, said recesses ending in the openings, the legs of the second part being guided along said recesses upon relative movement of the parts.

4. Battery terminal post clamp according to claim 2, wherein the guide means constrains the parts to lateral motion relative to the battery terminal post.

5. Battery terminal post clamp according to claim 2, wherein the guide means retains said facing portions in facing coplanar relation during movement of the parts.

6. Battery terminal post clamp according to claim 2, wherein the guide means prevents longitudinal motion of the parts relative to the battery terminal post.

7. Battery terminal post clamp according to claim 2, wherein the guide means connects the parts to each other independent of the control means.

8. Battery terminal post clamp according to claims 1 or 2 wherein one of the parts has means for connection to one or more cables.

9. Battery terminal post clamp according to claim 1 or 2 wherein the toggle joint mechanism is connected to portions of said parts other than said facing portions.

10. Battery terminal post clamp according to claims 1 or 2, wherein the toggle joint mechanism comprises a substantially U-shaped operating lever having two parallel legs extending outside the first and second parts, a shaft by means of which the legs of the operating lever adjacent their ends are pivotably mounted in the legs of one of the parts, and a substantially U-shaped link having a portion parallel to the shaft, said portion being pivotably mounted in the legs of the other part and having two legs extending from said portion, the ends of said legs of said link being parallel to the shaft and engaging the legs of the operating lever at a greater distance from the ends of said operating lever legs than does the shaft.

11. Battery terminal post clamp according to claim 10, wherein the shaft is mounted in the legs of said one part adjacent the ends thereof, said pivotably mounted portion of the U-shaped link is mounted in the legs of the other part adjacent the legs thereof, and the ends of the legs of the link are turned inwardly to the shaft.

* * * * *